US010709950B1

(12) United States Patent
Wilkins

(10) Patent No.: US 10,709,950 B1
(45) Date of Patent: Jul. 14, 2020

(54) GOLF PRACTICE APPARATUS

(71) Applicant: Charles A. Wilkins, Flat Rock, NC (US)

(72) Inventor: Charles A. Wilkins, Flat Rock, NC (US)

( * ) Notice: Subject to any disclaimer, the term of this patent is extended or adjusted under 35 U.S.C. 154(b) by 0 days.

(21) Appl. No.: 16/705,977

(22) Filed: Dec. 6, 2019

(51) Int. Cl.
*A63B 69/36* (2006.01)
*A63B 69/00* (2006.01)

(52) U.S. Cl.
CPC ..... *A63B 69/0091* (2013.01); *A63B 69/3661* (2013.01); *A63B 2209/08* (2013.01)

(58) Field of Classification Search
CPC ..... A63B 69/0091; A63B 2209/08; A63B 69/3661
USPC ..... 473/136, 140, 146, 147, 149, 419, 423, 473/429
See application file for complete search history.

(56) References Cited

U.S. PATENT DOCUMENTS 1,690,158 A * 11/1928 Currie ..... A63B 69/0079 473/146
2,929,632 A * 3/1960 Moffatt ..... A63B 69/0079 473/143
5,178,393 A * 1/1993 Dennesen ..... A63B 24/0021 473/140
5,390,930 A * 2/1995 Hu ..... A63B 69/0091 473/149
5,513,847 A * 5/1996 Hu ..... A63B 69/0091 473/140
5,743,820 A * 4/1998 Espinosa ..... A63B 69/0079 473/429
5,803,836 A * 9/1998 Beintema ..... A63B 69/0091 473/429
6,322,460 B1 * 11/2001 Asci ..... A63B 69/0002 24/114.5
6,786,831 B1 9/2004 Wu
7,115,044 B2 10/2006 Faltin
7,811,183 B1 * 10/2010 Ohle ..... A63B 69/002 473/429
2009/0280918 A1 11/2009 Rutherford
2018/0140924 A1 * 5/2018 Kent ..... A63B 69/36

* cited by examiner

*Primary Examiner* — Nini F Legesse
(74) *Attorney, Agent, or Firm* — John G. Posa; Belzer PC

(57) ABSTRACT

A golf practice device uses magnetic attraction to implement a ball return function. A ball is fastened to a tether coupled to a post enabling the ball and tether to rotate in a plane around the post when the ball is struck by a golf club. The plane of rotation is at a non-zero angle relative to the ground plane to simulate a launch angle. The magnetic coupling causes the ball to come to rest in the same general position on the playing surface following the rotation. The device is adapted for temporary attachment to a playing surface such as a typical artificial grass mat, and the ball may be a hollow, plastic ball such as a perforated wiffle ball. The ball is also rotatable about the longitudinal axis of the tether to further mimic actual ball flight dynamics. The device can be used for hitting, pitching and chipping practice.

13 Claims, 2 Drawing Sheets

GOLF PRACTICE APPARATUS

FIELD OF THE INVENTION

This invention relates generally to golf practice aids and, in particular, to a simple yet effective golf practice device with a ball auto-return feature.

BACKGROUND OF THE INVENTION

There are numerous golf practice devices described in the patent literature and on sale commercially. One device described in U.S. Pat. No. 5,390,930 features a magnetically restored ball position. Thus prior art golf practice device includes a pivoting base fixed on a mat or a grass yard, and a golf ball secured on a linking arm having a sleeve pivotally mounted on a shaft vertically erected on the pivoting base. Two rotor magnets having opposite outer magnetic poles are diametrically secured on two opposite ends of the sleeve, and two stator magnets having opposite inner magnetic poles are respectively secured on two opposite ends of a hanging bracket fixed on a top portion of the shaft. A rotation gap is defined between the rotor magnets and the stator magnets. A mutual attraction is established between each rotor magnet and each stator magnet, whereby upon striking of the ball by a club for rotating the ball, the ball will be stopped at its starting position as automatically restored by the magnetic force acting between each stator magnet and each rotor magnet.

There are several drawbacks and problems associated with this device. First, the device uses a standard golf ball that is fixedly secured onto the linking arm. As such, the ball does not rotate about a ball axis, as would be the case with an actual putt or golf club swing. Further, standard golf balls are dense and heavy objects such that if the ball becomes detached it may cause damage or injury. In addition, the linking arm rotates in a plane parallel to the mat or grass yard which also deviates from actual play insofar as balls hit with an iron or wood would assume an angled loft. A further shortcoming is that while the device uses magnetic attraction to restore ball position, it also uses magnetic repulsion, relying upon four magnets which increases complexity and manufacturing costs. The device is also secured to a mat or yard, decreasing flexibility and versatility.

Other, similar type devices on the market also use real golf balls which are inherently dangerous and prohibitive for indoor use. One such device is a vertical hanger design attached by a rope. It is notoriously difficult to adjust so that the ball rests on the hitting surface and breaks after minimal repeated use. The other device is an attachment to an expensive mat system that spins horizontally and has no stopping mechanism. Given the existing solutions, there remains an outstanding need for a less expensive, more versatile golf practice apparatus with a ball return function that more faithfully simulates ball flight dynamics experienced during actual play.

SUMMARY OF THE INVENTION

This invention broadly resides in a golf practice device that exploits magnetic attraction to implement a ball return function to the same region on a mat or other playing surface. The device includes a rigid post having upper and lower ends defining a length, and wherein the lower end of the post is connected to a fastener adapted for temporary attachment to a playing surface defining a ground plane. A ball is fastened to the distal end of a tether coupled to the post in a manner enabling the ball and tether to rotate in a plane around the post when the ball is struck by a golf club. The plane of rotation is at a non-zero angle "A" relative to the ground plane to simulate a ball trajectory. For example, the non-zero angle between the plane of rotation and the ground plane is in the range of 30 to 40 degrees.

The device further includes a magnetic coupling between the tether and the post structure causing the ball to come to rest in the same general position on the playing surface following the rotation after the ball is struck. The preferred embodiment comprises a single permanent magnet and a single magnetic element. One of the magnet and the magnetic element is positioned on a non-magnetic member extending outwardly from the post, and the other of the magnet and magnetic element is fastened to the tether. In the most preferred embodiment, a rare-earth magnetic disk is disposed on the upper surface of a disk through which the post extends, and a ferrous element is disposed on a proximal portion of the tether. The disk may be or a rubbery or other flexible material, enabling the magnet and magnetic element to make physical contact at least when the ball comes to rest on the playing surface.

The fastener adapted for temporary attachment to a playing surface may be a spring clamp, and the ball may be a hollow, plastic ball such as a perforated wiffle ball. In the preferred embodiment, the tether is at somewhat flexible and resilient, and may be implemented with a commercially available plastic cable tie. The distal end of the tether may extend through the ball, with fasteners disposed on opposing surfaces of the ball. Such a construction allows the ball to be rotatable about the longitudinal axis of the tether, thereby further simulating actual ball flight dynamics.

Used correctly, the invention is safe for indoor use. The device can be used for hitting, pitching and chipping practice and is especially helpful in overcoming the "hit impulse" which is difficult for beginner golfers. The spring clamp facilitates use with any golf mat.

DETAILED DESCRIPTION OF THE PREFERRED EMBODIMENTS

Figure 1:
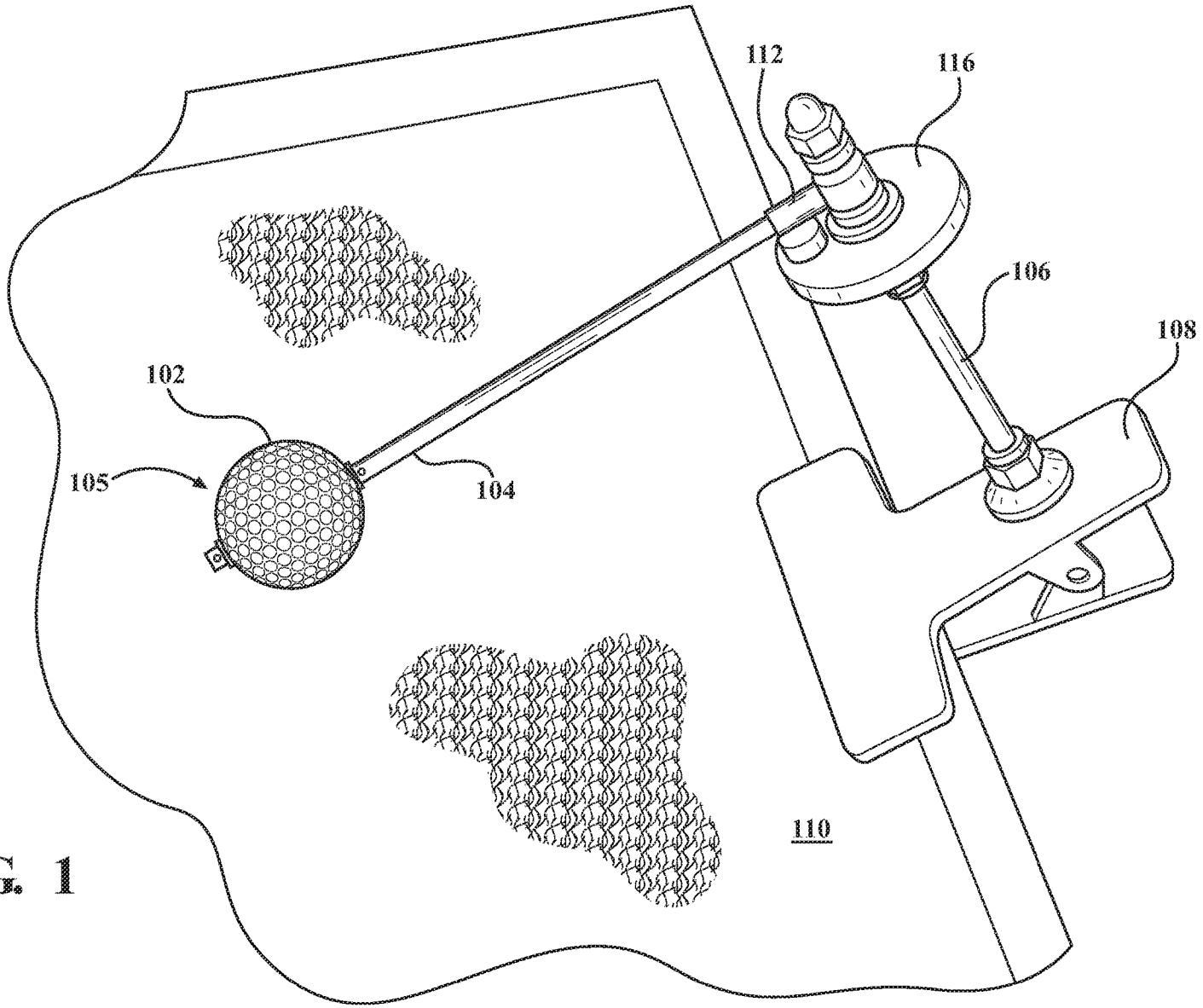
FIG. 1 is a perspective view of a preferred embodiment of the invention.

Now making reference to the accompanying drawings, FIG. 1 is a perspective view that illustrates a preferred embodiment of the invention. In broad and general terms, before describing preferred components, the device includes a ball 102 coupled to a tether 104 enabling the ball and tether to spin around a post 106. In the preferred embodiment, shaft 106 is attached to a clamp 108 that may be affixed to a mat or other practice surface 110.

A magnetic element (i.e., ferrous) 112 is coupled to the tether 104 proximate to the post 106, and a magnet 114 is disposed on an extension, preferably disk-shaped plate 116. In contrast to existing devices, ball 102 is preferably a lightweight perforated ball such as a 'wiffle ball,' and tether 104 extends all the way through the ball to a component 105. The combination of a lighter-weight plastic perforated ball, and more secure tether, together facilitate indoor use while minimizing accidents.

Ball 102 may also spin about the axis of tether 104, and the length of tether 104, shaft 106 and angle of the clamp 108 are selected so that the ball leaves the surface 110 at an angle when hit. The combination of spin and loft angle more faithfully simulate the type of ball dynamic experienced during actual play. Further, in terms of reduced cost, only one magnetic member and one magnet are required, and the upward polarity of magnet 114 may be N or S on disk 116. While having a magnetic element on the tether and magnetic 114 on a shaft extension is preferred, in an alternative embodiment, the magnet may be disposed on the tether with a magnetic element on a disk or other fixed extension.

Figure 2:
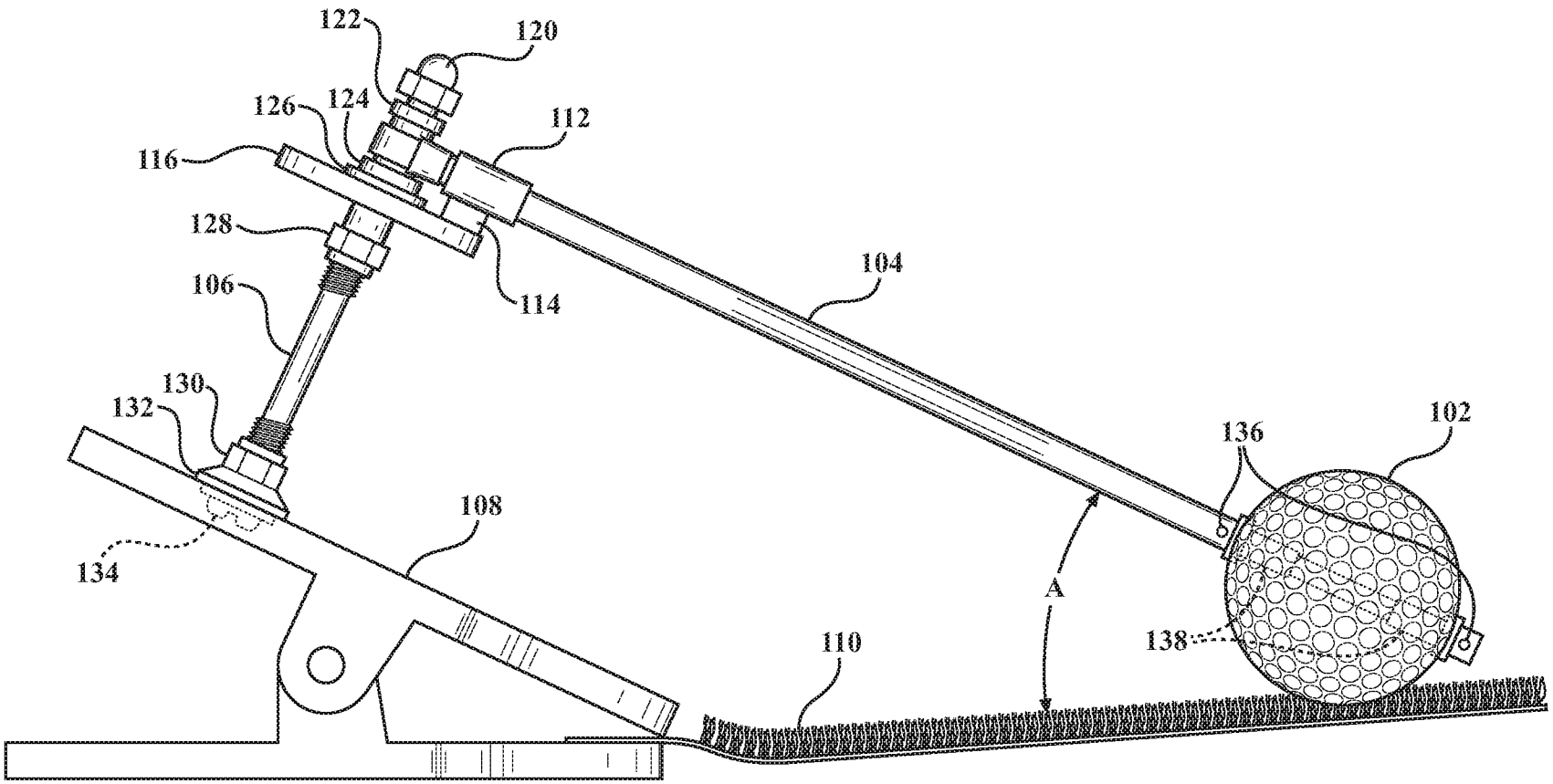
FIG. 2 is detailed drawing of the preferred embodiment illustrating component parts.

Having described the overall structure of the device, the reader's attention is now directed to FIG. 2, which provides further details with respect to a preferred construction. To begin, post 106 may use any suitable structural element. In the preferred embodiment a 3½" 10-24 steel bolt is used. While not shown, the exposed threads may be covered with a suitable plastic sleeve, shrink tubing, or the like. Bolt 106 is inserted through a hole drilled in one grip of spring clamp 108 with the head 134 of the bolt underneath the upper grip as shown. A nut 130 and lockwasher 132 may be used to secure the bolt 106 to the spring clamp 108.

Spring clamp 108 may be a heavy duty 'muslin' type steel clamp with rubber tips, having a width of 2 or more inches, preferably 4.5", and an opening greater than 1", preferably 2" or more. Disk 116 must be non-magnetic, so a neoprene fender washer may be used, having the dimensions 1½×¼×⅛ inches. Materials other than neoprene may be used, including aluminum, stainless steel, or nylon, though the latter may present issues associated with cementing magnet 114.

A second nut 128 is threaded onto the bolt 106 to establish a surface for a series of components upper components. Disk 116 is fastened to pronged T-nut 126 using the prongs of the nut and optionally fortified with superglue. Item 124 is a bushing. Permanent magnet 114 is bonded to disk 116, also with superglue. The magnet 114 is may be a rare earth (i.e., neodymium) magnet having a 0.315" diameter and 0.115" thickness.

Tether 104 is preferably a type 21 cable tie secured to a #10 nylon bushing. The other end of cable tie 104 is cut to length, threaded through ball 102, and secured at opposing ends of the ball with removable hitch or bent cotter pins 136. Items 138 are bushings. A cut length of 7", more or less, has been found to useful and reliable, though other lengths in the range of 5 to 12" may also be used. No. 10 pins may be used to secure Whiffle balls, or #8 pins may be used for other types of balls. The cable tie tether 104 is cut to length such that ball 102 rests on the surface 110 with the tie generally outstretched, as shown. In the preferred embodiment, the tether 104 is flexible or bendable yet resilient such that it remains in a generally straight condition (unless over-bent). The relative flexibility of tether 104 is important to the invention, as it allows the ball 102 to actually rest upon the surface 110 at the magnetically returned position. This is in contrast to prior-art devices that use a rigid arm, which never truly allow the ball to contact the playing mat or surface 110.

A 3/16" nylon washer 122 is journaled over threaded post 106, followed by a cap nut 120, completing the assembly. Magnetic collar 112 may be implemented with a toothed lanyard clamp, crimped on cable tie tether 104 so as to be directly above magnetic 114. In the preferred embodiment, elements 112, 114 may actually make contact when the ball 102 comes to rest, which is advantageous compared to leaving gap which may cause ball to stop at slightly different positions between each swing. Indeed, the rubber washer disk 116 acts as a "spring" in allowing the magnet to attract the metallic contact 112 on the cable tie so that the struck ball returns to the same start position.

Furthermore, the use of a spring clamp, in conjunction with a appropriately proportioned post and tether, provide a natural and desirable angle between the tether 104 and playing surface 110. Such an angle, preferably on the order of 20 to 45 degrees, more preferably in the range of 30 to 40 degrees. Most preferably, the ball and tether swing in a plane of about 35 degrees relative to "ground," which simulates a "launch angle" of the type generally encountered when striking an actual golf ball during a drive, for example.

The invention claimed is:

1. Golf practice apparatus, comprising:
a rigid post having a central, longitudinal axis and upper and lower ends defining a length;
wherein the lower end of the post is connected to a fastener adapted for temporary attachment to a playing surface defining a ground plane such that the axis of the post is at an acute angle relative to the playing surface;
a tether having proximal and distal ends defining a length;
a ball fastened to the distal end of the tether;
wherein the proximal end of the tether is coupled to the post in a manner enabling the ball to rotate in a plane around the post when the ball is struck by a golf club, and wherein the plane of rotation is at a non-zero angle relative to the ground plane; and
a magnetic coupling causing the ball to come to rest in the same position on the playing surface following the rotation after the ball is struck.

2. The golf practice apparatus of claim 1, wherein the fastener adapted for temporary attachment to a playing surface is a spring clamp.

3. The golf practice apparatus of claim 1, wherein the ball is a hollow, plastic ball.

4. The golf practice apparatus of claim 1, wherein the ball is a hollow, plastic, perforated ball.

5. The golf practice apparatus of claim 1, wherein the tether is flexible and resilient.

6. The golf practice apparatus of claim 1, wherein the tether is a plastic cable tie.

7. The golf practice apparatus of claim 1, wherein the magnetic coupling comprises a single permanent magnet and a single magnetic element.

8. The golf practice apparatus of claim 7, wherein one of the magnet or the magnetic element is positioned on a non-magnetic member extending outwardly from the post, and the other of the magnet or magnetic element is fastened to the tether.

9. The golf practice apparatus of claim 8, wherein the non-magnetic member extending outwardly from the post is a disk through which the post extends.

10. The golf practice apparatus of claim 9, wherein the disk is a flexible disk enable the magnetic and magnetic element to make physical contact following the rotation after the ball is struck.

11. The golf practice apparatus of claim 1, wherein the ball is rotatable about the tether.

12. The golf practice apparatus of claim 1, wherein the distal end of the tether extends through the ball, with fasteners disposed on opposing surfaces of the ball.

13. The golf practice apparatus of claim 1, wherein the non-zero angle between the plane of rotation and the ground plane is in the range of 30 to 40 degrees.

* * * * *